US006560784B2

(12) United States Patent
Hill

(10) Patent No.: US 6,560,784 B2
(45) Date of Patent: May 13, 2003

(54) MULTI-LAYERED MOISTURE RESISTANT HAIR WRAP

(76) Inventor: Jordan Heather Meredith Hill, 612 Mariposa Ave., #210, Oakland, CA (US) 94610

( * ) Notice: Subject to any disclaimer, the term of this patent is extended or adjusted under 35 U.S.C. 154(b) by 0 days.

(21) Appl. No.: 10/072,584

(22) Filed: Feb. 5, 2002

(65) Prior Publication Data

US 2002/0104150 A1 Aug. 8, 2002

Related U.S. Application Data

(60) Provisional application No. 60/265,923, filed on Feb. 5, 2001.

(51) Int. Cl.[7] ..... A42B 1/04

(52) U.S. Cl. ..... 2/171; 2/204

(58) Field of Search ..... 2/171, 171.2, 174, 2/410, 9, 206, 207, 200.1, 200.2, 175.4, 209.13, 209.14, 171.4, 171.5, 171.8, 172, 204, 918; 607/109, 110

(56) References Cited

U.S. PATENT DOCUMENTS

| | | | |
|---|---|---|---|
| 1,172,927 | A | 2/1916 | Bloch |
| 1,501,591 | A | 7/1924 | Gage |
| 1,600,530 | A | 9/1926 | Becker et al. |
| 1,626,433 | A | 4/1927 | Siner |
| 1,652,933 | A | 12/1927 | Gaskell |
| 1,861,669 | A | 6/1932 | Van Sickle |
| 1,991,982 | A | 2/1935 | Hodges |
| 2,142,201 | A | 1/1939 | Mayer |
| 2,158,571 | A | 5/1939 | Culp |
| 2,175,849 | A | 10/1939 | Oliner |
| 2,211,184 | A | 8/1940 | Varell |
| 2,579,089 | A | 12/1951 | Price |
| 2,700,977 | A | 2/1955 | Neerup |

(List continued on next page.)

FOREIGN PATENT DOCUMENTS

| | | |
|---|---|---|
| FR | 2 390 116 | 12/1978 |
| GB | 2171 | 2/1886 |
| IT | 462984 | 4/1951 |

OTHER PUBLICATIONS

"Spartan Durag," www.treasuredlocks.com, Treasured Locks (Ohio, U.S.A.), (2002)(consisting of 2 pages from site).

"Classic Turbans," www.turbans.com, Classic Turbans, (1997)(consisting of 2 pages from site).

"EK Shower Caps," www.eklbc.com, EK Shower Caps (California, U.S.A.) (2002) (consisting of 2 pages from site).

"Turbie Twist," www.buyinnovations.com, Buy Innovations.Com, (2002)(consisting of 2 pages from site).

"Du–Rags," www.villagestreetwear.com, BeWild.com (New York, U.S.A.) (2002) (consisting of 3 pages from site).

"Wrap Star," www.wrap–star.com, Wrap Star (California, U.S.A.) (2002) (consisting of 3 pages from site).

"Herban Stylz," www.herbanstylz.com, Herban Stylz (Vermont, USA), (2001) (consisting of 1 page from site).

"Turban Plus," www.turbanplus.com, Turban Plus (California, U.S.A.) (2002) (consisting of 7 pages from site).

"Headcovers Unlimited," www.headcovers.com, Headcovers Unlimited (Oklahoma, U.S.A.) (2002) (consisting of 8 pages from site).

*Primary Examiner*—Gary L. Welch
(74) *Attorney, Agent, or Firm*—Charles Cypher

(57) ABSTRACT

A multi-layered moisture resistant hair wrap surrounds a person's entire head of hair protecting, maintaining, and prolonging a hairstyle and adapted to do so in moist environments that include water, steam, mist and humidity and absorbing moisture generated from heat or perspiration from one's scalp.

21 Claims, 7 Drawing Sheets

U.S. PATENT DOCUMENTS 2,804,695 A * 9/1957 Scott ..... 2/174
2,889,557 A 6/1959 Blair
3,131,400 A 5/1964 Blanchard et al.
3,197,787 A 8/1965 Tognan et al.
3,268,913 A 8/1966 Gettinger
3,750,681 A 8/1973 Clauch
4,382,446 A * 5/1983 Truelock et al. ..... 607/110
4,400,830 A 8/1983 Gaitan
4,964,175 A 10/1990 Taylor
5,161,260 A 11/1992 Reynolds
5,305,470 A 4/1994 McKay
5,465,741 A 11/1995 Dvorak
5,469,579 A 11/1995 Tremblay et al.
5,477,561 A 12/1995 Adkins
5,621,919 A 4/1997 Graham
5,781,932 A 7/1998 Brown
5,806,535 A 9/1998 Becker
5,845,654 A 12/1998 Johnson
5,850,636 A * 12/1998 Reuven ..... 2/171.2
5,920,909 A 7/1999 Ellsworth et al.
5,950,234 A 9/1999 Leong et al.
6,151,712 A 11/2000 Lampi
6,182,294 B1 * 2/2001 Pulley ..... 2/171
6,202,218 B1 3/2001 Chen
D448,917 S 10/2001 Grant

* cited by examiner

MULTI-LAYERED MOISTURE RESISTANT HAIR WRAP

This application claims the benefit of an earlier filed provisional application, application No. 60/265,923, filed Feb. 5, 2001, the contents of which are incorporated herein by reference.

BACKGROUND OF THE INVENTION

This invention relates to head coverings used to protect the cosmetics or styling of a wearer's hair during activity.

Many persons pay a hairdresser, stylist or barber to cut and style their hair. Hair, belonging to persons of various ethnic backgrounds, tends to curl-up, shrink, wave, frizz or simply lose its styling when it comes into contact with moisture. It is the purpose of the present invention to keep moisture away from the styled hair of the wearer, and thereby protect it and prolong the style.

There are many different types of devices for protecting hair from the elements and moisture: many of which have been patented. Prior art hair or head coverings include: shower caps, sleeping caps, general caps, hats, bonnets, bands and wraps. Many of these devices perform well in one or two specific environments. The current invention address several issues relating to protecting a wearer's hair style: including the wearer's comfort, durability of the device, aesthetics, and maintaining or prolonging the wearer's current hairstyle under moist conditions.

Shower caps are round, plastic or rubber caps. A shower cap is usually made with elastic sewn around the inner edges of the cap to hold it on the wearer's head and protect the hair from water while showering. Shower caps often do not prevent water from reaching the front and back hairline of the wearer. Furthermore, they tend to shift with activity or movement of the wearer. Shower caps also tend to hold in moisture generated from perspiration, which develops near the scalp underneath the cap, defeating the purpose of keeping moisture from outside the cap from saturating the hair and scalp. Furthermore, plastic caps tend to collect mildew in their creases, and are not generally considered to be aesthetically pleasing.

Sleeping turbans and hair caps are meant to protect the wearer's hair while they are sleeping. A sleeping turban is generally made from various fabrics such as chiffon or nylon with two elongated strips or ties to secure the turban around the wearer's head. The inventor has found that some turbans must be tied so tightly around the wearer's head to keep them secure that they leave marks from the elastic on the head after use.

Sleeping caps or turbans also appear to be intended only for indoor use and do not appear to protect the hair style from moisture.

Other caps, such as the device taught by F. Becker in U.S. Pat. No. 1,600,530, granted in 1925, are designed not just to protect the wearer's hair style but to actually change it. This patent teaches a cap that so closely fits the head of the wearer that it is supposed to straighten the hair and maintain it in a straightened condition while the hair is drying after washing or treatment.

Hair nets, such as that taught by S. Oliner in U.S. Pat. No. 2,175,849 (1938), also serve to hold a hair style in place and protect the hair style during activity or while sleeping. Being open to the air; however, hair nets do not prevent moisture from saturating the hair.

Hats are generally used as an outdoor head covering to protect the hair and or head. Hats are available in many different types, styles and color and often are intended only to provide a pleasing appearance, rather than protect the hair style or head of the wearer. Rain hats that are waterproof or water resistant usually tie under the chin which can be uncomfortable. They also do not seem appropriate for indoor uses such as bathing. Generally, hats tend to disturb the wearer's hairstyle when they are put on or taken off.

Another example of prior art head wear is the bonnet. A bonnet is generally a triangular piece of material. It may include elongated strips or draw strings that tie under the chin to secure it. Bonnets serve to protect the hair and skin of the wearer from rain and sun, and wind to a lesser extent.

Presently, there is a need for a device that maintains and prolongs hair styles that require dry, cool environments, whether the hair style to be protected and maintained is curly or straight.

The present invention provides a device that protects the entire head of hair. The present invention provides a device that protects the hair style from ambient moisture. The present invention provides a device that protects the hair style of the wearer from moisture produced by the body. The present invention provides a multi-layered device that allows air spaces above the hair of the wearer. The present invention provides a device that is aesthetically pleasing that can be worn inside the home or out of doors in public. The present device provides a hair covering that is comfortable to wear. The present invention provides a device that is durable.

Additional objects of the invention are to provide a device that is flexible in use and wear, comfortable, adaptable and, provides the consumer an inexpensive and convenient moisture resistant hair wrap to protect, maintain and prolong their current hairstyle whether that style be wet or dry in nature.

OBJECT OF THE PRESENT INVENTION

The primary object of the present invention is the provision of a hair wrap for protecting and prolonging a hair style when worn in moist environments, as found in showers, baths, pools, saunas, fitness facilities, spa facilities, cruise ships and boats, etc.

It is a further objection of the present invention to provide a hair wrap that is capable of being used in various climates and circumstances.

It is a further objection of the invention to provide a multi-layered hair wrap with a sheet member which is moisture resistant.

It is a further objection of the invention to provide a multi-layered hair wrap with moisture absorbing material such as desiccant to protect the hair style of the wearer from excessive moisture.

It is a further object of the present invention to provide a hair wrap which increases the potential for consumers to save both time and money on salon or barber services.

It is a further object of the present invention to provide a hair wrap which prevents moisture generated by perspiration from destroying the current hairstyle of the user.

It is a further object of the present invention to provide a hair wrap which may be produced in numerous colors and prints which will allow for an extremely wide range of decorative or fashionable options.

It is a further object of the present invention to provide a hair wrap which will present a decorative outer surface having an elegant and pleasing appearance.

It is a further object of the present invention to provide a hair wrap which will provide a convenient multi-purpose alternative to current hair protective devices.

It is a further object of the present invention to provide a sturdy hair wrap which can be worn during general activity without requiring a cool, dry external environment or careful movement on the part of the user.

It is a further object to provide a hair wrap construction that allows for an adaptable, comfortable and adjustable fit to serve a wide range of head sizes.

It is a further object to provide a hair wrap which covers the entire surface of the user's head having hair and can remain in place without the use of additional devices.

It is a further object to provide a hair wrap which is mildew resistant.

It is a further object to provide a hair wrap which allows air to circulate between the scalp and the wrap member itself.

It is a further object to provide a hair wrap which can be worn in or out of doors under various circumstances which will alleviate the requirement for consumer to own more than one hair-covering device.

It is a further object to provide a hair wrap which can be stretched, pulled and positioned comfortably on the head of the user;

It is a further object to provide a hair wrap which will function in various climates and temperatures.

Additional objects, advantages, and features of the present invention will become apparent from the description to follow and the accompanying claims, when taken in conjunction with the accompanying drawings.

DESCRIPTION OF THE PREFERRED EMBODIMENT

Figure 1:
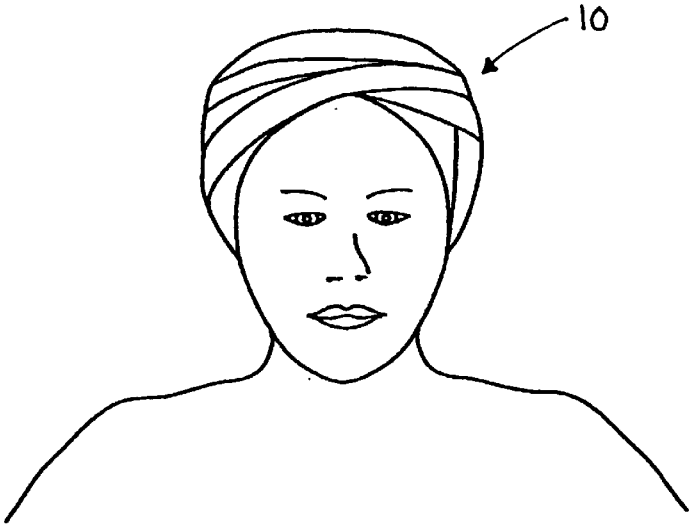
FIG. 1 is a schematic front view of the hair wrap of the present invention completely installed on the head of the user.
Figure 2:
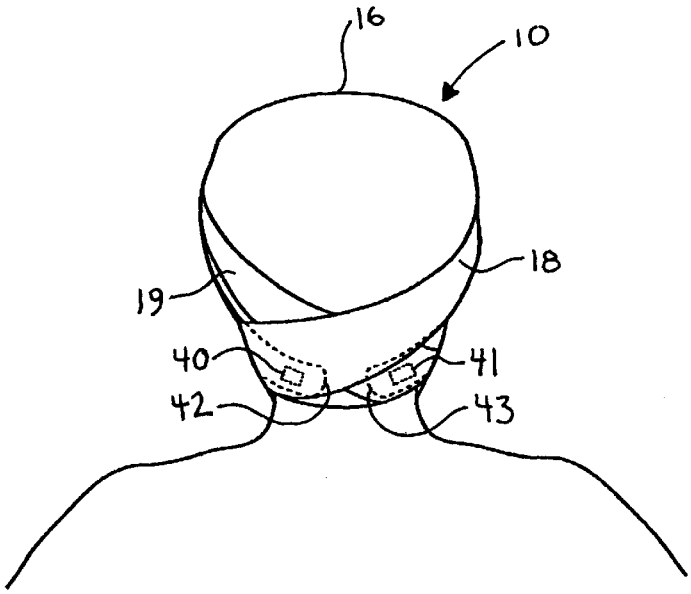
FIG. 2 is a schematic rear view of the hair wrap of the present invention completely installed on the head of the user.
Figure 3:
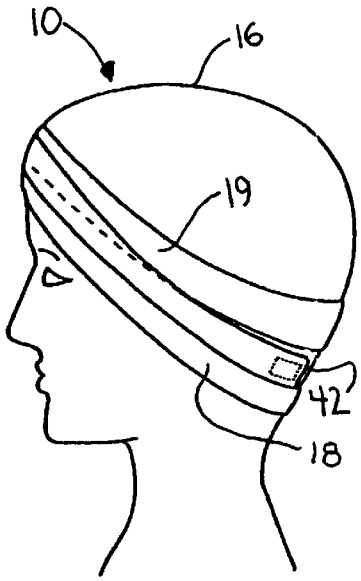
FIG. 3 is a schematic left side view of the hair wrap of the present invention completely installed on the head of the user.

The preferred embodiment of the hair wrap 10 or closure of the present invention is illustrated in FIG. 1, showing a front view, and FIG. 2, showing a rear view. In the preferred embodiment, the hair wrap 10 is comprised of one sheet made from first, second, third, fourth and fifth flexible layers of material 26, 28, 30, 32, 34, respectively (see FIG. 6A). In the preferred embodiment, the hair wrap 10 has a center-portion 16 designed for covering and enveloping the entire surface of the head covered with hair, excluding facial hair, but including the upper front, rear, sides, and top portion of the head. Such hair will also be called scalp hair herein. The center portion 16 extends front-to-back from the forehead to the nape of the neck. In the preferred embodiment, the center portion 16 preferably has an approximate width of seventeen inches; front to rear, and a length of thirteen inches; ear to ear. At a minimum the center portion 16 encirles the head of the wearer.

It is necessary to cover the entire surface of the head with scalp hair to protect the hair style in its entirety from moisture and the other elements. To accomplish this, in the preferred embodiment, the hair wrap 10 includes a center portion 16, having a front portion 12, a rear portion 14, and first and second members 18 and 19 or extensions or extended members that wrap around the center portion 16, encirling the head, and hold the hair wrap 10 to the head. In the preferred embodiment, where the center portion 16 is large enough to envelope the wearer's head of hair or scalp, the center portion 16 measures about twenty-two inches in circumference. In the preferred embodiment, the first and second members 18 and 19 encirle the head passing over the forehead, the ears and the nape of the neck or close to it.

Figure 4:
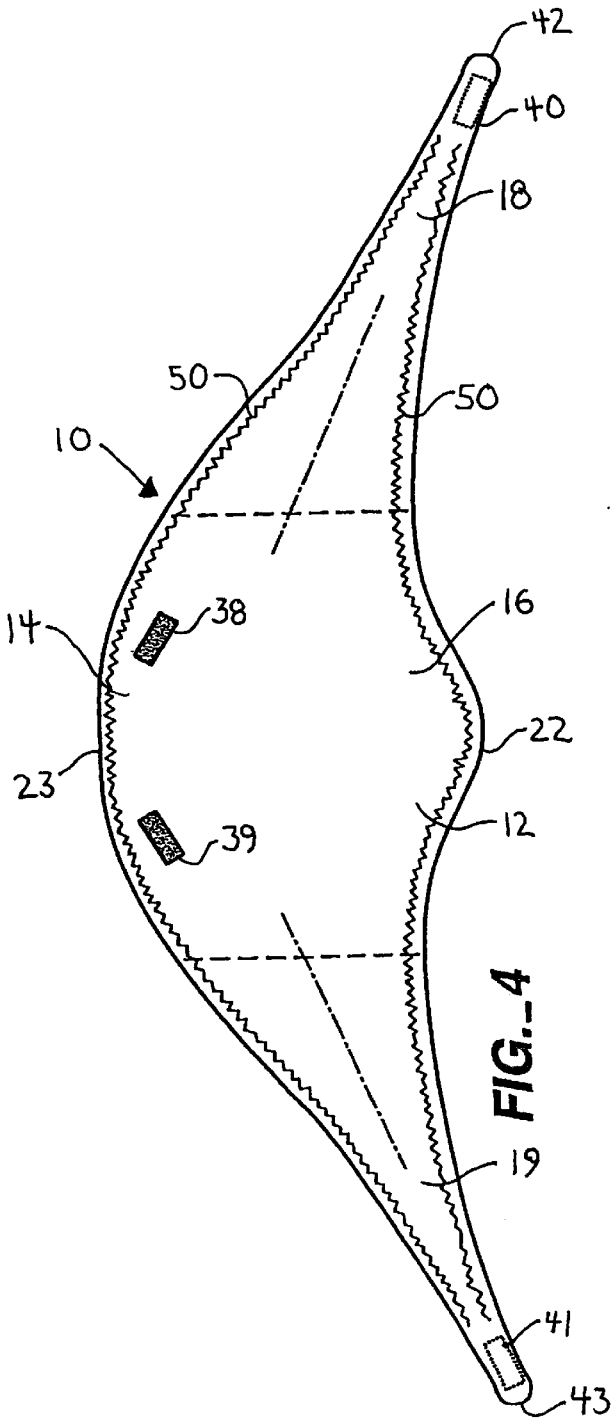
FIG. 4 is a top view of the hair wrap of the present invention, outstretched over the head for the positioning of the wrap on the head of the user. For ease of understanding, the elastic used on the front and rear edges of the hair wrap is shown, although it would not be visible from the top.

As best shown in FIG. 4, typically, the hair wrap 10 measures about seventy-eight inches long from the end 42 of the first member 18 to the end 43 of the second member 19, enabling the wrap 10 to fit different sized heads and accommodate a range between thick and thin hairstyles.

The hair wrap 10 typically has a width ranging from two to seventeen inches, starting from the ends 42 and 43 of the first member and second member 18 and 19 and moving inwardly toward the middle of the center portion 16 of the wrap 10. Viewing FIG. 5 it will be apparent that the front portion 12 is typically shorter in length than the rear portion 14.

To better hold the wrap (see FIG. 7A) at the hairline at the forehead and nape of neck areas, it is preferred to sew clear, thin, and waterproofed elastic 50 to the front and rear edges 22 and 23 of the of the hair wrap 10. One such elastic 50 goes by the trademark Stretchrite®.

Figure 5:
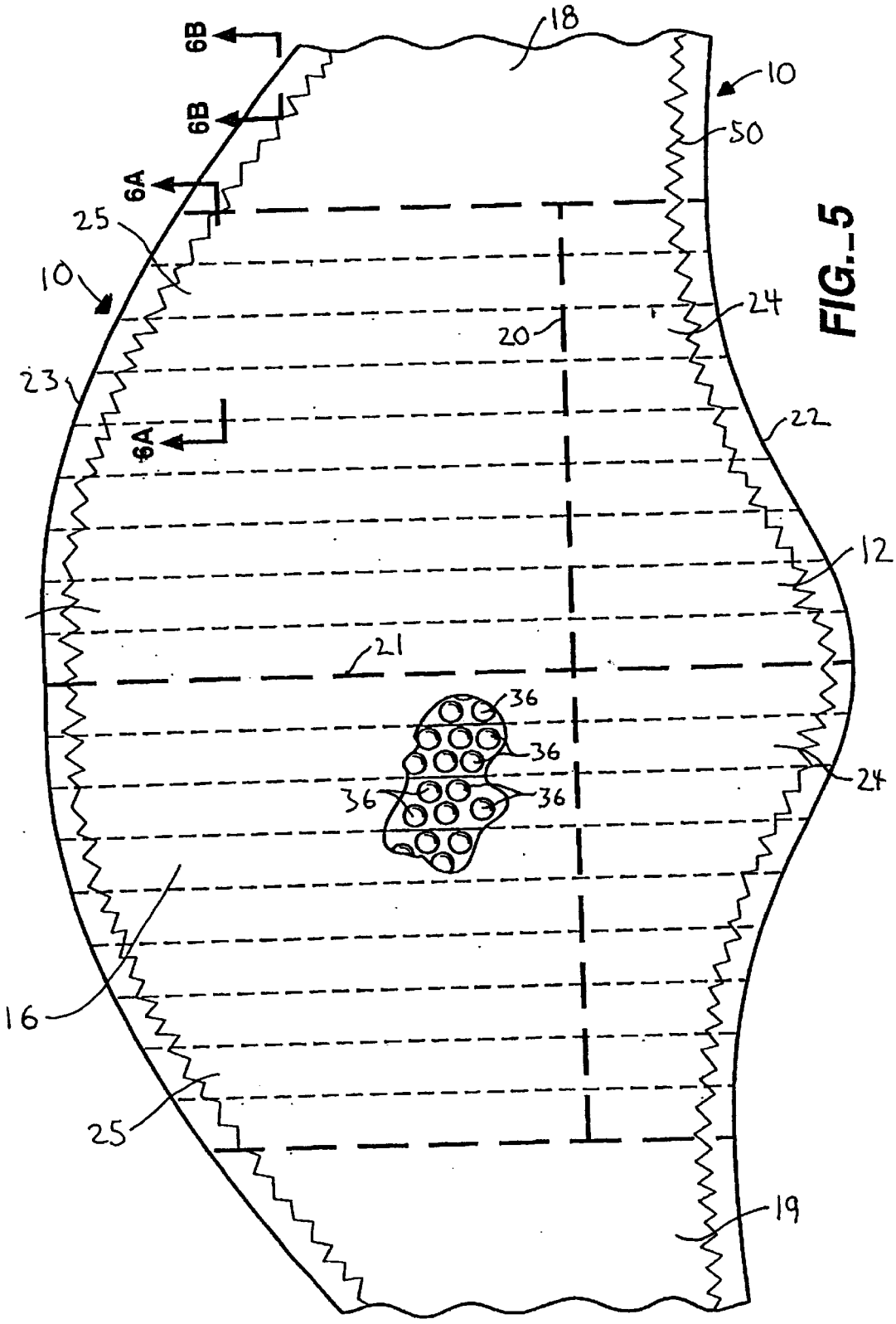
FIG. 5 shows a portion of the hair wrap of the present invention in a view similar to FIG. 4 with the outer layer removed, showing the stitching pattern that creates the plurality of channels and seams to evenly distribute the desiccant on the surface area of the head of the user, preventing the desiccant from accumulating into one area or another on the head. The elastic is also shown, although it would not necessarily be visible in this view.

Preferably, the elastic 50 as shown in FIG. 5, is sewn to create tight bunching in both the front portion 12, measuring about nine inches long, and the rear portion 14, measuring about fourteen inches long. In the remaining portions of the front and rear edges 22 and 23 of the hair wrap 10, the waterproof elastic 50 is sewn so as to create looser bunching. The elastic provides additional stretching and pulling, creating a seal around the circumference of the head and which may be necessary for the wearer to adjust the hair wrap 10 comfortably around the head. The waterproof elastic 50 at the front edge 22 and the rear edge 23 allows increased flexibility and adaptability of the hair wrap 10 to one's hairstyle.

Preferably, one quarter of an inch is allowed for a folded-over seam in order to conceal the nylon thread and elastic 50. By doing this, the aesthetics of the hair wrap 10 remain stylish and pleasing to the eye.

The first member 18 and second member 19 extend outwardly from the center portion 16, preferably decreasing in width from the center portion 16 to the end 42 of the first member 18 and the end 43 of the second member 19. The first and second members 18 and 19 measure about thirty-two inches long and taper from the center portion 16 to their ends 42 and 43, where they are approximately two-inches wide. Where the first and second members 18 and 19 join the center portion 16 they are approximately 5 inches wide. Tapering the first and second members 18 and 19 from the mid center of the wrap 10 to either distal end 42 and 43 creates a wrapped appearance, as shown in FIG. 1, which ensures increased stability of the hair wrap 10 and decreases the amount of fabric that surrounds the head.

Figure 7A:
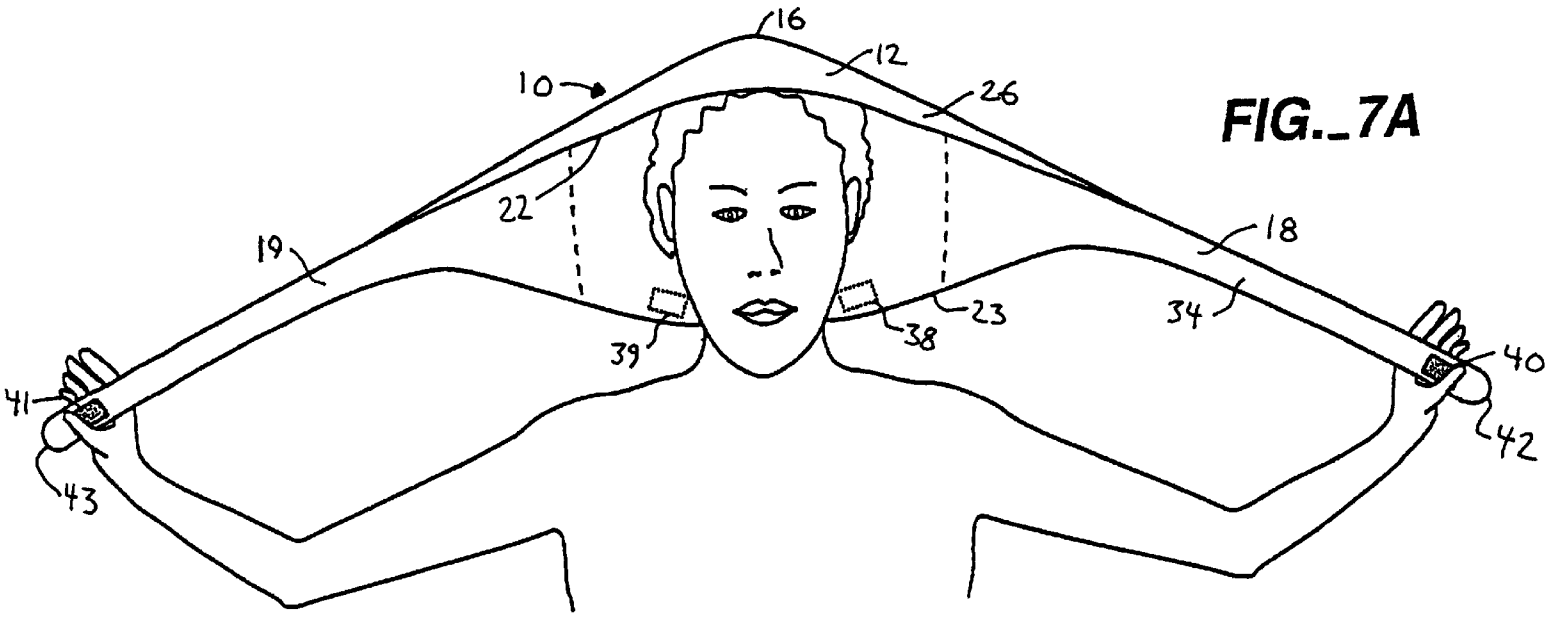
FIG. 7A is a front view of the present invention, showing the wrap outstretched on the head of the user in a first position with the user providing tension on the rear edge of the hair wrap.
Figure 8A:
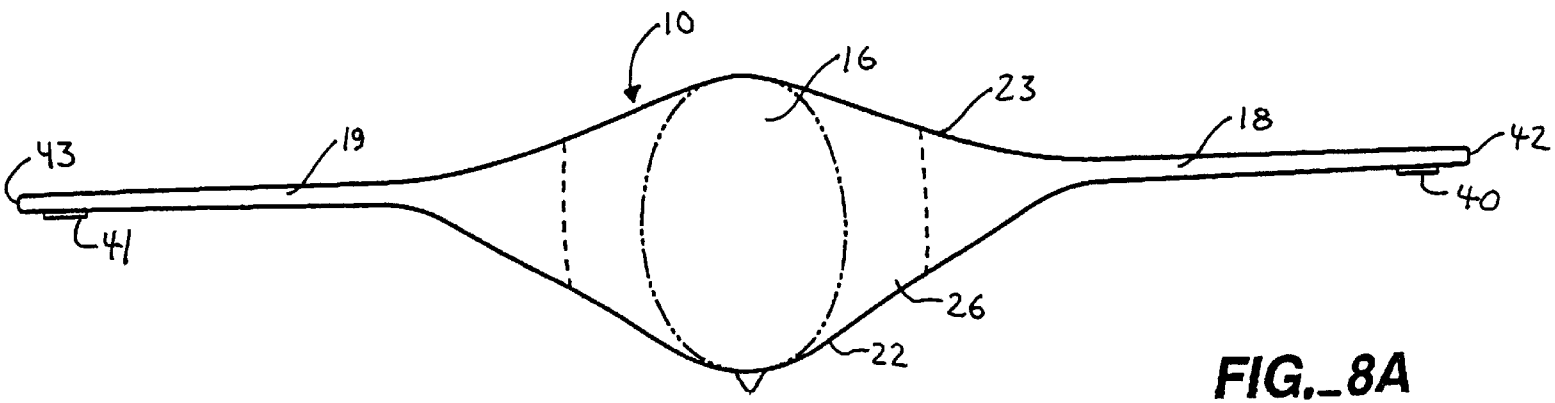
FIG. 8A is a schematic top view of the present invention, showing the wrap outstretched on the head of the user in a first position with the user providing tension on the rear edge of the hair wrap.

As shown in FIGS. 4 and 7A in the preferred embodiment, the first and second members 18 and 19 have inner connecting strips 40 and 41. In the preferred embodiment, the inner connecting strips 40 and 41 comprise a swatch of hooks for use in a releasable hook and loop fastener, such as the trademarked product Velcro®. The swatch of hooks are positioned on the underside of the fifth layer 34. The inner connecting strips 40 and 41 are about three-and-one-half inches long, three-quarters of an inch wide and positioned one-half of an inch in from the ends 42 and 42 of first and second members end 18 and 19.

In the preferred embodiment, the inner connecting strips 40 and 41 join with surface connecting strips 38 and 39 positioned on the outermost first layer 26. In the preferred embodiment, the surface connecting strips 38 and 39 are swatches of loops for a hook and loop fastening system. The surface connecting strips 38 and 39 are positioned about three inches away from the mid-line of the center portion 16. The surface connecting strips 38 and 39 are about two-and-one-half inches long and three-quarters of an inch wide.

There are preferably round edges at the ends 42 and 43 of first and second members 18 and 19 as shown in FIG. 4.

As shown in FIGS. 8A, 8B, 9, 10, and 11 the first member 18 and second member 19 are wrapped around the head and secured to their respective surface connecting strips 38 and 39.

Figure 6B:
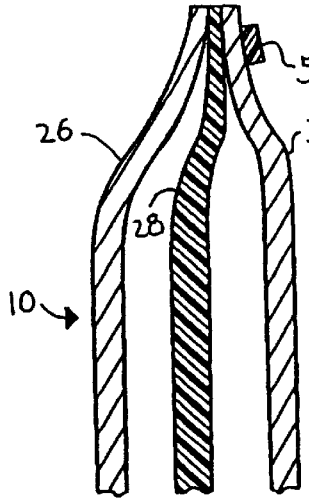
FIG. 6B is a schematic cross-sectional view taken along the line 6B—6B in FIG. 5 of an alternate embodiment of the invention, having only three layers.
Figure 6A:
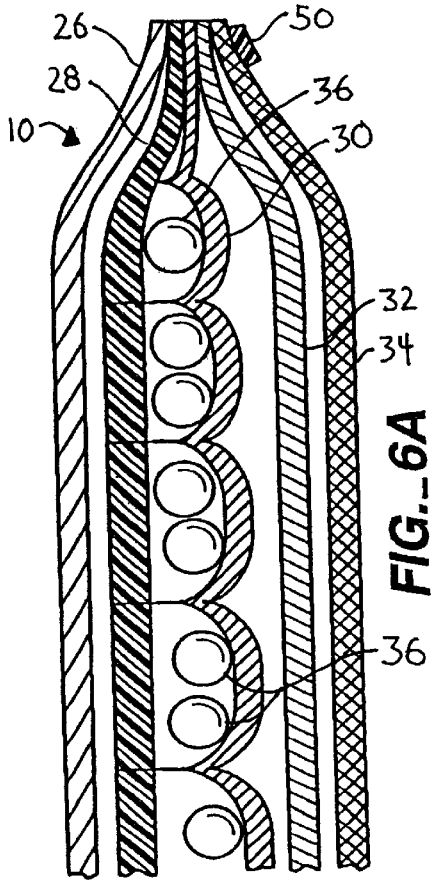
FIG. 6A is a schematic cross-sectional view taken along the line 6A—6A in FIG. 5. For purposes of understanding the invention, in this figure the top layer of the hair wrap is shown.

All five layers 26, 28, 30, 32 and 34 of the hair wrap 10 can be viewed in FIG. 6A. As shown in FIG. 6A, the first layer 26 or cover layer functions as the top outermost layer and can be viewed by others when the wrap is worn. The first layer 26 preferably imparts a decorative and draping effect. For the first layer 26 a fabric like double georgette silk is preferred. The fabric is lightweight, flexible, and imparts a draping affect and dries quickly. This allows various decorative and fashionable options. The wrap 10 could match swim wear, bath wear, sleep wear or other piece of clothing of the wearer. Preferably, the first layer 26 conceals the second layer 28 and the remaining layers.

FIG. 6A shows the second layer 28 or protective layer which is preferably a water-proof, flexible, lightweight and thin fabric, such as vinyl. The second layer 28 is water-proof to prevent moisture from penetrating the hair wrap 10. The hair is therefore protected from moisture in the environment whether it is in the form of rain, shower water, steam, mist etc. The second layer 28 could also be merely water repellent, water resistant or resist water in certain states such as a material that is impermeable to water droplets, but allows gaseous water to pass, although such a wrap 10 would not be as effective in certain environments.

The second layer 28 is sandwiched together with a third layer 30 or sandwich layer of fabric in order to create a domain which holds a desiccant 36 or absorbent in the hair wrap 10. The desiccant 36 can be in the form of beads. The third layer 30 is preferably a natural, woven, breathable, lightweight, thin, flexible and fast drying fabric such as silk chiffon or linen blend. Air is able to filter up through this third layer 30 into the domain where the desiccant 36 resides. Thus, moisture generated from perspiration and steam for instance can be absorbed away from the scalp of the user. Therefore, the amount of moisture accumulating between the second layer 28 and the user's scalp is diminished, allowing the current style to be prolonged. The desiccant will also capture any moisture that is able to penetrate the second layer 28 or comes under the second layer 28 at the edges 22 and 23 of the hair wrap 10.

As shown in FIG. 6A, in the preferred embodiment, a fourth layer 32 or breathing layer is used. It is preferably a natural, woven, breathable, thin, flexible and fast drying fabric such as silk chiffon or linen blend. Because the fourth layer 32 is breathable it allows air to circulate between the scalp and the second layer 28. The fourth layer 32 allows moisture to be absorbed by the desiccant at a slower rate. The fourth layer 32 serves to balance the rate of absorption of moisture from the scalp into the desiccant 36. The fourth layer 32 also provides an additional layer to hold the desiccant away from the scalp of the user.

As shown in FIG. 6A the hair wrap 10 is provided with a fifth layer 34 or contacting layer that is preferably a breathable, flexible, thin, lightweight, smooth surfaced fabric such as a mesh material positioned as the layer lying closest to the hair and scalp of the user. This fifth layer 34 is preferably textured to provide a certain grip on the hair for stabilizing the wrap 10 on the head. As moisture develops on the head of the user it rises up through the mesh or like material, passes through the fourth layer 32, then into the third layer 30, and is then absorbed by the desiccant 36. Thus, rather than holding in moisture under plastic or other non porous materials, moisture is allowed to pass through the small porous holes in the mesh or like material, allowing the scalp to breath and consequently reduces the amount of initial moisture generated by warm temperatures.

In the preferred embodiment, all five layers 26, 28, 30, 32 and 34 have the same measurements and are held together by sewing a double-stitched seam of nylon thread along the outermost edges 22 and 23 of the hair wrap 10.

Additionally, in the preferred embodiment, once moisture from the scalp or hair reaches the preferably water-proof second layer 28 it is unable to penetrate through it. With additional layers such as the fourth 32 and fifth 34 layers moisture between the scalp and the second layer 28 is more likely to remain captured between the sandwiched layers and away from the scalp, allowing the desiccant 36 additional time and opportunity to absorb it.

The desiccant 36 shown in FIGS. 5 and 6A is preferably silica gel or another FDA approved desiccant that is safe to use in this application. The silica gel is distributed evenly throughout the center portion 16 which covers the entire surface of the head covered with hair. Therefore, moisture generated from perspiration around the hairline and head is evenly absorbed at an appropriate rate, protecting the cosmetic integrity of the wearer's hairstyle. The amount of desiccant to utilize is determined by the guidelines described by the manufacturer. One manufacturer recommends about one pound of desiccant for each ten square foot area. Placing the hair wrap 10 in the microwave oven, conventional oven or dryer at around two hundred degrees Fahrenheit for approximately four to six hours regenerates the desiccant 36 and does not damage the fabric or other materials. This regeneration allows the user to repeat use of the hair wrap 10.

As shown in FIG. 5, preferably, a horizontal seam 20 and a vertical seam 21, or one or more seams with like positioning and function, are sewn into the second layer 28 made of vinyl fabric and the third layer 30 made of silk chiffon blend fabric to prevent the silica gel beads 36 from accumulating in either in the front portion 12 or the rear portion 14 on the user's head creating an uneven distribution of absorbent material. Since most of the gravity pull is toward the rear portion 14 of the head, having a horizontal seam aids in holding the desiccant 36 in place around the front portion 12 and top of the head. Without an even distribution of desiccant 36, the ability of hair wrap 10 to absorb moisture will be diminished and so will the likelihood of maintaining the cosmetics of one's current hairstyle.

The horizontal seam 20 is sewn from the distal left side of the center portion 16 to the distal right side of the center portion 16. The width of the horizontal stitched seam 20 is approximately thirteen inches. This prevents the silica gel beads from shifting or accumulating in the front portion 12 or rear portion 14 of the wrap.

The vertical seam 21 is sewn from the front portion 12 at the forehead to the rear portion 14 of the head at the nape of the neck. The width of the vertical seam 21 is about seventeen inches.

FIG. 5 also shows the preferred front channels 24 and rear channels 25 that may be sewn vertically on either side of the vertical seam 21 and above and below the horizontal seam 20, to cover the center portion 16. The channels 24 and 25 are sewn into the second layer 28 and the third layer 30 to distribute the desiccant 36 evenly around the center portion 16 and to prevent the desiccant 36 from shifting excessively.

In the preferred embodiment, sandwiched between the vinyl layer 28 and the silk layer 30 is about 2.72 ounces of a desiccant 36 such as silica gel that is evenly dispersed above and below the vertical seam 21 and the horizontal seam 20 to cover the entire center portion 16 or hair area with an absorbent material. The width of each channel is approximately one-half inch. These channels cover the length and the width of the entire center portion 16.

Figure 7B:
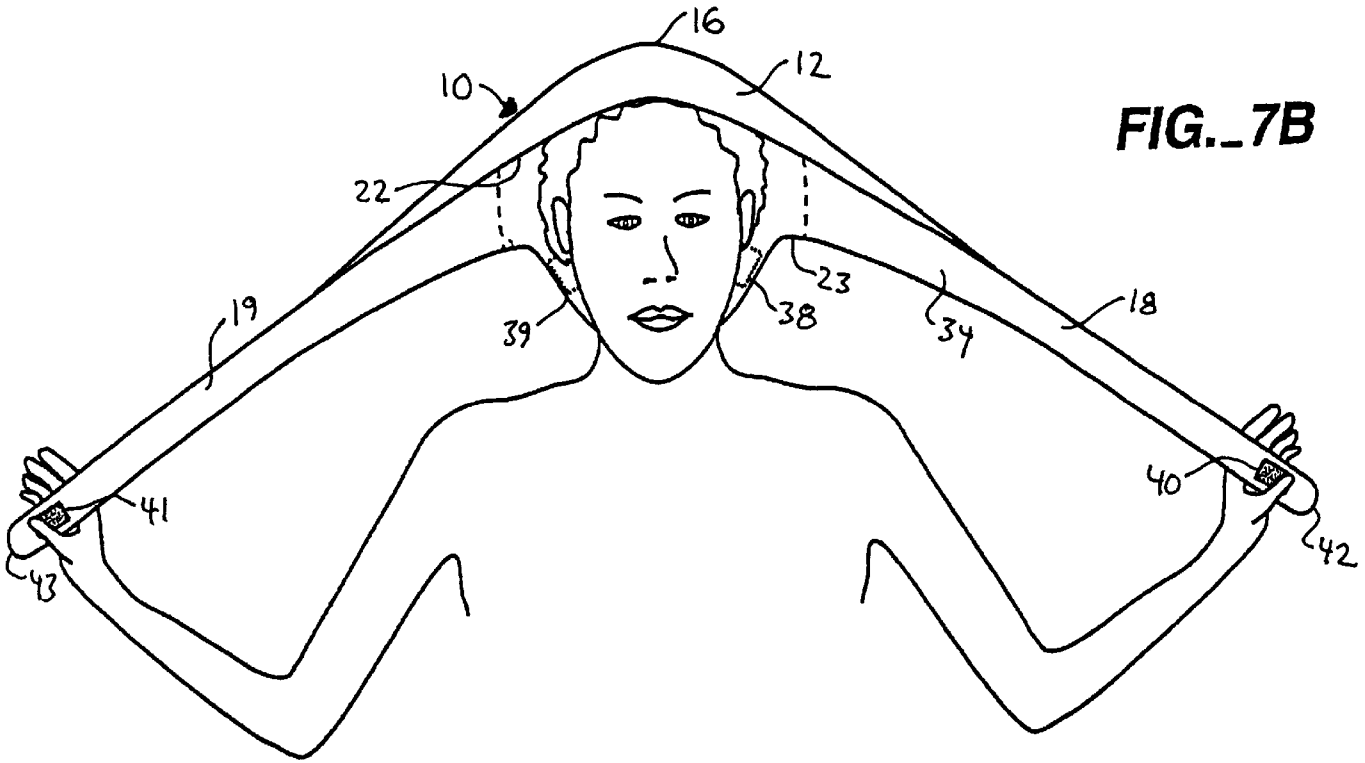
FIG. 7B is a front view of the present invention, showing the wrap outstretched on the head of the user in a first position with the user providing tension on the front edge of the hair wrap, and the rear edge haning loosely.
Figure 8B:
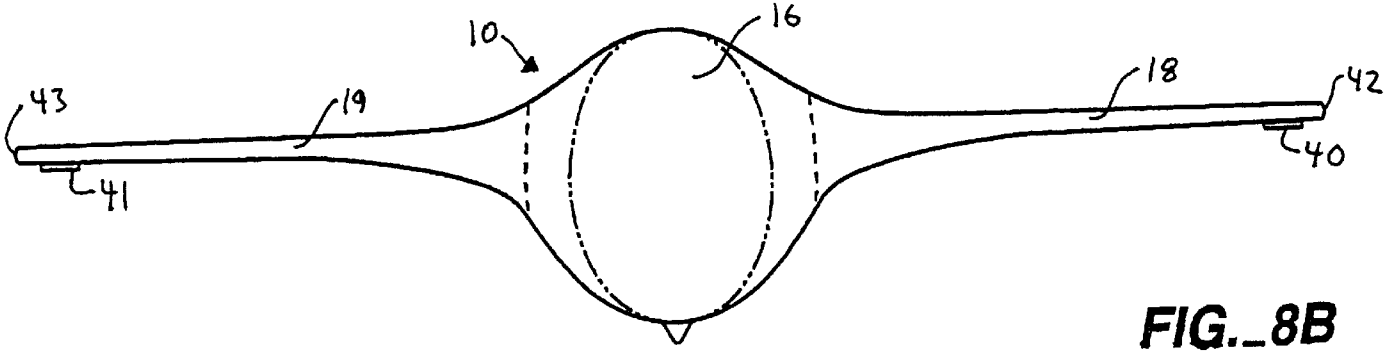
FIG. 8B is a schematic top view of the present invention, showing the wrap outstretched on the head of the user in a first position with the user providing tension on the front edge of the hair wrap.
Figure 9:
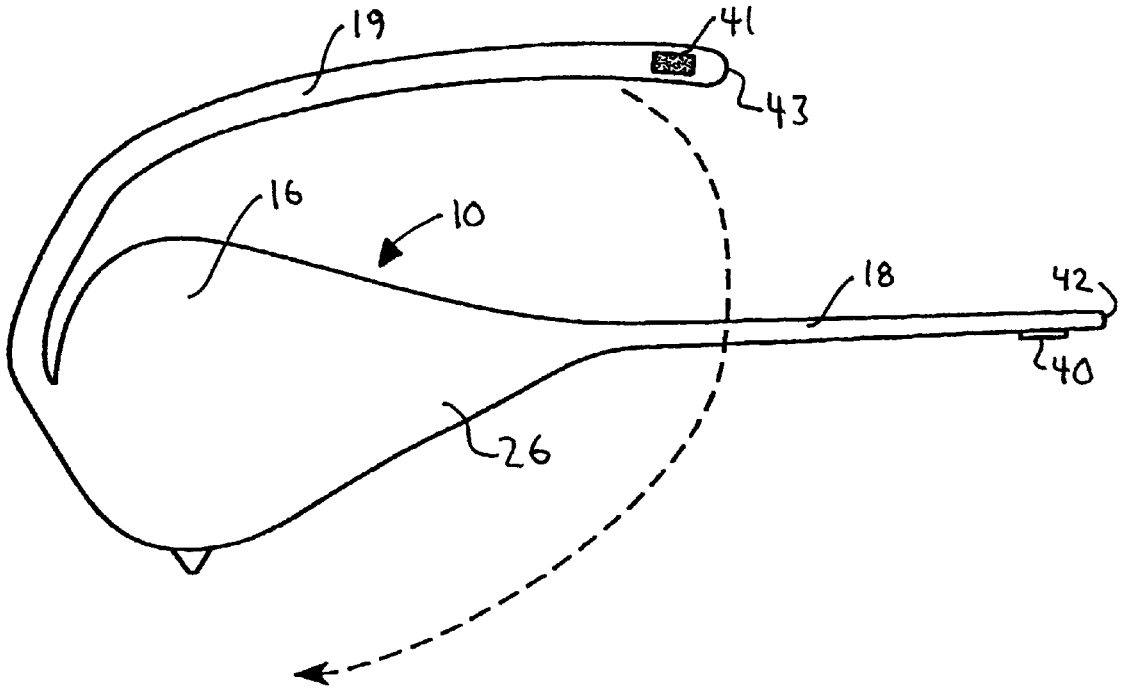
FIG. 9 is a schematic top view of the present invention being installed on the head of the user, showing the folding of the first member and the wrapping of the first member around the back of the wearer's head.
Figure 10:
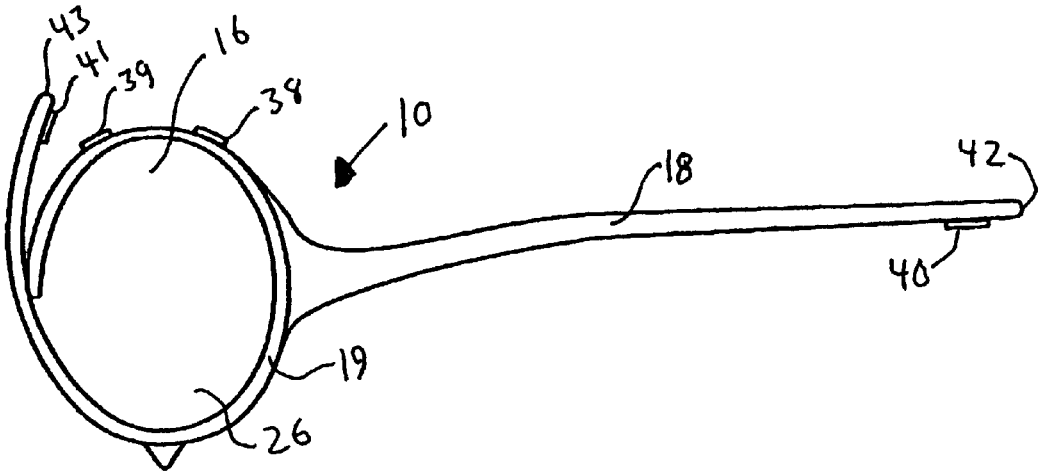
FIG. 10 is a schematic top view of the present invention being installed on the head of the user, showing the first member of the present invention encircling the head and about to be secured to the back of the hair wrap.

In use, the hair wrap 10 is placed over the head having first member 18 and second member 19 in first position with the center portion 16 on the head, as shown in FIGS. 7A and 7B. The wrap 10 is held by the user with the first and second members 18 and 19 extended and outstretched to the sides of the head and the front portion 12 is positioned on the forehead and the rear portion 14 is positioned at the nape of neck. Then, the first member 18 may be folded to a second position, as shown in FIG. 9, and then circled around the entire head, going around the back of the head first. The first member 18, as it passes around the opposite side of the head and by the second member 19, wraps above the second member 19, as shown in FIG. 9. When the first member 18 has completed a circuit around the head of the wearer, the inner connecting strip 40 of the first member 18 can then be secured to the surface connecting strip 38 on the rear portion 14 of the wrap 10, completing one half of the installation in third position as shown in FIG. 10.

Figure 11:
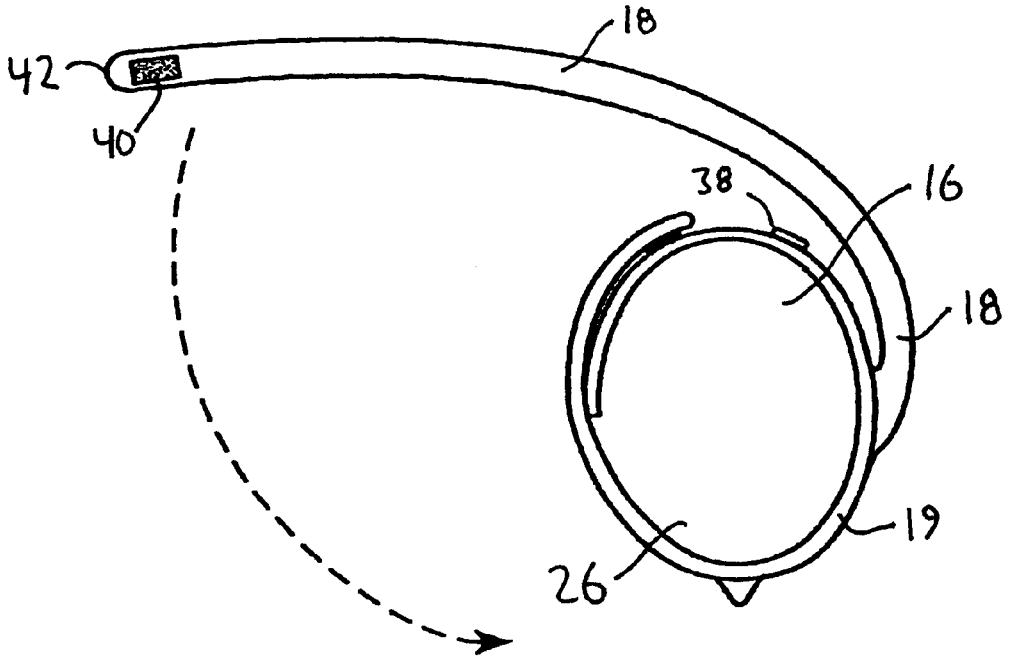
FIG. 11 is a schematic top view of the present invention being installed on the head of the user, showing the folding of the second member and the wrapping of the second member around the back of the wearer's head.
Figure 12:
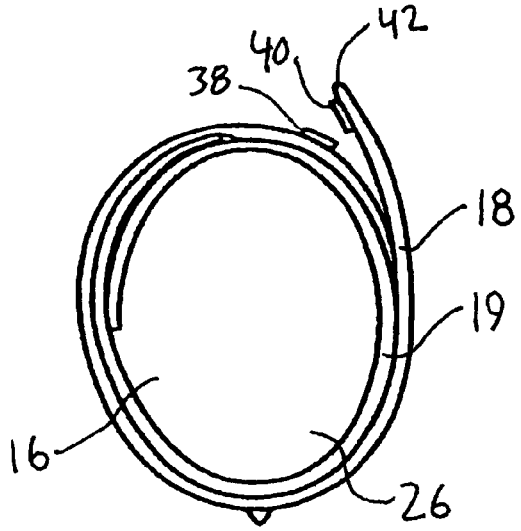
FIG. 12 is a schematic top view of the present invention being installed on the head of the user, showing the second member of the present invention encircling the head of the user and about to be secured to the back of the hair wrap.

Then, the second member 19 may be folded, as shown in FIG. 11, and circled around the entire head, going around the back of the head first. The second member 19, as it passes around the opposite side of the head, wraps over the fold in the first member 18. When the second member 19 has completed a circuit around the head of the wearer, the inner connecting strip 41 of the second member 19 can then be secured to the surface connecting strip 39 on the rear portion 14 of the wrap, completing the installation in fourth position as shown in FIG. 12.

By bringing the first and second members 18 and 19 completely around the center portion 16 of the hair wrap 10 in opposite directions, the center portion 16 is pressed close to the surface of the head (see FIG. 9), creating a seal around the hair line and circumference of the head.

Optionally, the end 43 of the second member 19 may be hidden under a fold of the first member 18 towards the rear portion 14. The end 42 of the first member 18 is likely to be hidden under the second member 19.

The above description should not be construed as limiting the scope of the invention, but as merely providing illustrations of some of the presently preferred embodiments of this invention. For example, the hair wrap 10 may be constructed to have a different shape to customize it to a particular person's head. The hair wrap 10 can also be constructed using different materials such as tencel rayon blends, nylon and nylon blends, alternative grades of vinyl or water-proof fabrics, woven natural fabrics such as linen, wool crepe, gabardine and various other types of silk, polyester and polyester blends and numerous other fabrics and blends of fabrics that dry easily and that may serve the same or similar function. Altering the shape, construction or materials may provide additional options for use based on different fashion trends and consumer preferences within different cultural and other environments. Also, the length and width may be increased, decreased or altered to allow room for curlers to be worn by the user.

An alternative construction of the seams and channels may be utilized to distribute the desiccant around the entire sheet of the hair wrap. For example, the first and second members 18 and 19 may also include an absorbent 36 to further prevent moisture from saturating the area surrounding the head of the user. This particular construction would require more time, labor and materials when considering manufacturing and distribution. In addition, an alternative desiccant may be used if FDA approved for consumer safety. Furthermore, the various layers may be added or extracted to alter the weight, appearance or capacity of the hair wrap 10. For example, the fifth layer 34, made of a mesh material, may be limited to the center portion 16 of the wrap 10 so that the first and second members 18 and 19 do not include this material. Another example would be to remove layers of the wrap, so that only the first layer 26, the second layer 28, desiccant 36, and another lower layer were used. The function of this combination of layers would not be the most beneficial due to the enumerated benefits provided by all five layers.

The connecting strips 38, 39, 40 and 41 may be re-positioned or replaced with interlocking strips, hooks, or fasteners to provide alternatives to the user, to address a particular preference. Also, the water-resistant elastic 50 can be replaced with traditional fabric elastic.

The hair wrap 10 of the present invention may also be constructed to adapt to adding inserts that may perform a more specific function. For example, inserts can be adapted to include or promote healing by adding aromatherapy substances, medicines for chemotherapy patients, hair replacement processes, migraine medicines as well as other like applications. Inserts may also be constructed to adapt to the specific needs of consumers having dry, damaged or oily hair.

Additionally, the surface connecting strips 38 and 39 can be located on different locations on the hair wrap 10. Also, depending on which first or second member 18 or 19 the wearer chooses to wrap around the head first, the surface connecting strips 38 and 39 may either be hidden completely under the opposite first or second member 18 or 19, or it may be tucked under its corresponding first or second member's sides. Adjusting the location of surface connecting strip 38 or 39 would allow the construction of the hair wrap 10 to allow for additional styles, operation, sizes and number of times the wearer may wrap the first and second members 18 and 19 around the head.

Thus, the scope of the hair wrap 10 of the present invention should be determined by the present claims rather than by the specific examples given.

I claim:

1. A hair wrap device for protecting a wearer's hair style, comprising:

a. a protective layer of material for covering at least a portion of the hair on the scalp of the wearer's head, formed so that it can be disposed close to the scalp of the wearer, said protective layer of material being formed with front and rear edges, said protective layer creating an area between said front and rear edges that resists water penetration through said protective layer to said scalp;

b. a sandwich layer of material overlapping at least a portion of the protective layer of material and connected to the protective layer of material and having portions disposed between the scalp of the wearer's head and the protective layer, said sandwich layer being breathable;

c. desiccant in the form of a moisture absorbent material trapped between the protective layer of material and the sandwich layer of material substantially where they overlap to absorb moisture near the head of the wearer to protect the hair style of the wearer from moisture; and d. the protective layer of material is formed to encircle the head of the wearer.

2. The device of claim 1, wherein:

the protective layer of material is water resistant.

3. The device of claim 1, wherein:

the protective layer of material is water-proof.

4. The device of claim 1, wherein:

the protective layer of material is large enough to cover a substantial portion of the wearer's head, including the top of the head.

5. The device of claim 1, wherein:

the protective layer of material if formed with a center portion that covers the hair on the upper front, rear, sides, and top portion of the wearer's head.

6. The device of claim 5, wherein:

the sandwich layer corresponds in dimension to the protective layer.

7. The device of claim 1, further comprising:

a cover layer of material overlapping at least a portion of the protective layer of material and connected to the protective layer of material, and disposed above the protective layer of material with respect to the wearer's scalp.

8. The device of claim 1, further comprising:

a breathing layer of material overlapping at least a portion of the protective layer of material and connected to the protective layer of material and having portions disposed between the scalp of the wearer's head and the protective layer.

9. The device of claim 8, further comprising:

a contact layer of material overlapping at least a portion of the protective layer of material and connected to the protective layer of material and having portions disposed between the scalp of the wearer's head and the protective layer.

10. The device of claim 1, further comprising:

elongated first and second members which are connected to the protective layer and which are formed to encircle the head to help secure the hair wrap to the wearer's head.

11. The device of claim 10, wherein:

the protective layer of material is water resistant.

12. The device of claim 10, wherein:

the protective layer of material is water-proof.

13. The device of claim 10, wherein:

a plurality of channels are formed in the sandwich layer into which the desiccant is inserted, and the desiccant inserted in one channel cannot easily migrate to a different channel.

14. The device of claim 10, wherein:

the sandwich layer is divided into a plurality of portions by a seam that prevents shifting of the desiccant from one portion to another.

15. The device of claim 10, further comprising:

a cover layer of material overlapping at least a portion of the protective layer of material and connected to the protective layer of material, and disposed above the protective layer of material with respect to the wearer's scalp.

16. The device of claim 10, further comprising:

a. at least one surface connecting strip attached to hair wrap;

b. at least one inner connecting strip attached to one of the first and second members that can encircle the head of the wearer; the surface connecting strip and the inner connecting strip being formed to make a releasable bond with each other.

17. The device of claim 1, wherein:

an elastic member is attached to the protective layer, said elastic member being formed to substantially encircle the head to help secure the hair wrap to the wearer's head.

18. The device of claim 17, wherein: the protective layer of material is water-proof.

19. The device of claim 17, wherein:

a plurality of channels are formed in the sandwich layer into which the desiccant is inserted, and the desiccant inserted in one channel cannot easily migrate to a different channel.

20. The device of claim 17, wherein:

the sandwich layer is divided into a plurality of portions by a seam that prevents shifting of the desiccant from one portion to another.

21. The device of claim 17, further comprising:

a cover layer of material overlapping at least a portion of the protective layer of material and connected to the protective layer of material, and disposed above the protective-layer of material with respect to the wearer's scalp.

* * * * *